US006031508A

United States Patent [19]

Ishizuka et al.

[11] Patent Number: 6,031,508

[45] Date of Patent: Feb. 29, 2000

[54] ANTENNA ADJUSTER

[75] Inventors: Hironobu Ishizuka; Yasuhiro Ando; Masatoshi Shimizu; Shouji Tsurumoto, all of Tokyo, Japan

[73] Assignee: NEC Corporation, Japan

[21] Appl. No.: 09/076,638

[22] Filed: May 12, 1998

[30] Foreign Application Priority Data

May 12, 1997 [JP] Japan ..... 9-120950

[51] Int. Cl.[7] ..... H01Q 3/02

[52] U.S. Cl. ..... 343/882; 343/878; 343/880

[58] Field of Search ..... 343/878, 880, 343/882, 881, 890, 891, 892; 248/218.4; H01Q 3/02

[56] References Cited

U.S. PATENT DOCUMENTS

| | | | |
|---|---|---|---|
| 4,628,323 | 12/1986 | Crean | 343/765 |
| 5,154,386 | 10/1992 | Heck | 248/230 |
| 5,867,132 | 2/1999 | Blasing et al. | 343/890 |

FOREIGN PATENT DOCUMENTS

| | | | |
|---|---|---|---|
| 235561 | 9/1987 | European Pat. Off. | H01Q 1/12 |
| 268125 | 5/1988 | European Pat. Off. | H01Q 1/12 |
| 3127855 | 6/1983 | Germany | H01Q 1/12 |
| 60-145714 | 9/1985 | Japan | H01Q 3/04 |
| 61-154003 | 9/1986 | Japan | H01Q 1/12 |
| 61-176803 | 11/1986 | Japan | H01Q 1/12 |
| 61-288502 | 12/1986 | Japan | H01Q 1/12 |
| 63-15614 | 2/1988 | Japan | H01Q 3/08 |
| 63-153608 | 10/1988 | Japan | H01Q 3/08 |
| 6-260818 | 9/1994 | Japan | H01Q 1/42 |
| 7-106838 | 4/1995 | Japan | H01Q 3/08 |
| 2313957 | 12/1997 | United Kingdom | H01Q 1/12 |

*Primary Examiner*—Don Wong
*Assistant Examiner*—Shih-Chao Chen
*Attorney, Agent, or Firm*—Ostrolenk, Faber, Gerb & Soffen, LLP

[57] ABSTRACT

An antenna adjuster includes a clamp unit 10 including an upper and a lower clamp disposed one above another in the height direction of a pole 2, the upper and lower clamps including paired clamp members 11 and 14, and 12 and 13, respectively. The paired clamp members face each other via the pole and are secured to the pole so as to be capable of position adjustment in the height and peripheral directions of the pole 2. An antenna mounting member 20 is mounted on the upper clamp member 11 for rotation about an elevation angle rotation axis member 23 and secured to the antenna 1. An azimuth angle adjusting member 30 is capable of being displaced through an elongate hole 32 formed in the upper clamp member 11 and a threaded hole 33 formed in the lower clamp member 13. An elevation angle adjusting member 40 is capable of being screwed through an engagement hole 42 formed in the antenna mounting member 20 and a nut portion 43 of the upper clamp 11 to push and pull the antenna mounting member 20.

10 Claims, 10 Drawing Sheets

FIG. 6 *PRIOR ART*

FIG. 8 *PRIOR ART*
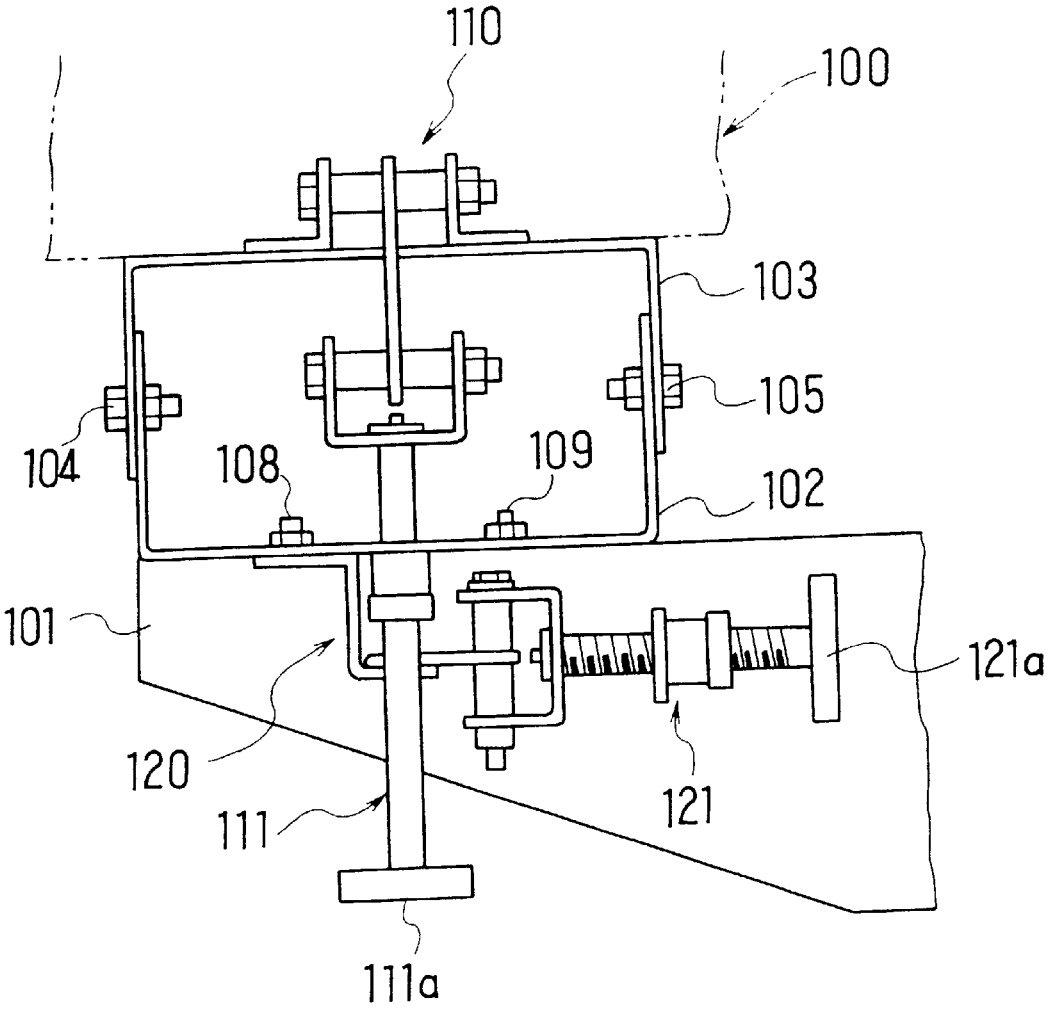

FIG. 9 *PRIOR ART*
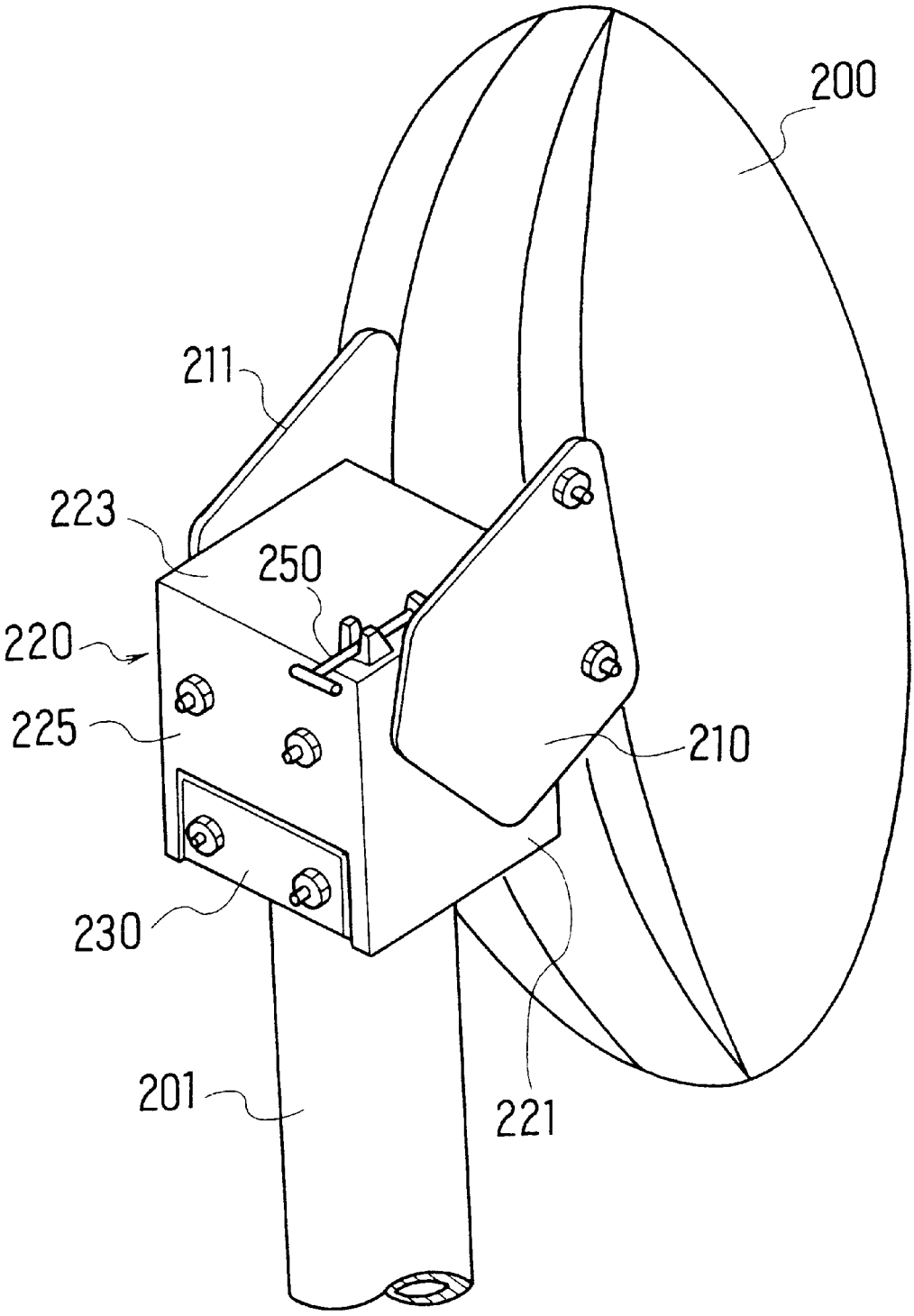

FIG. 10 *PRIOR ART*
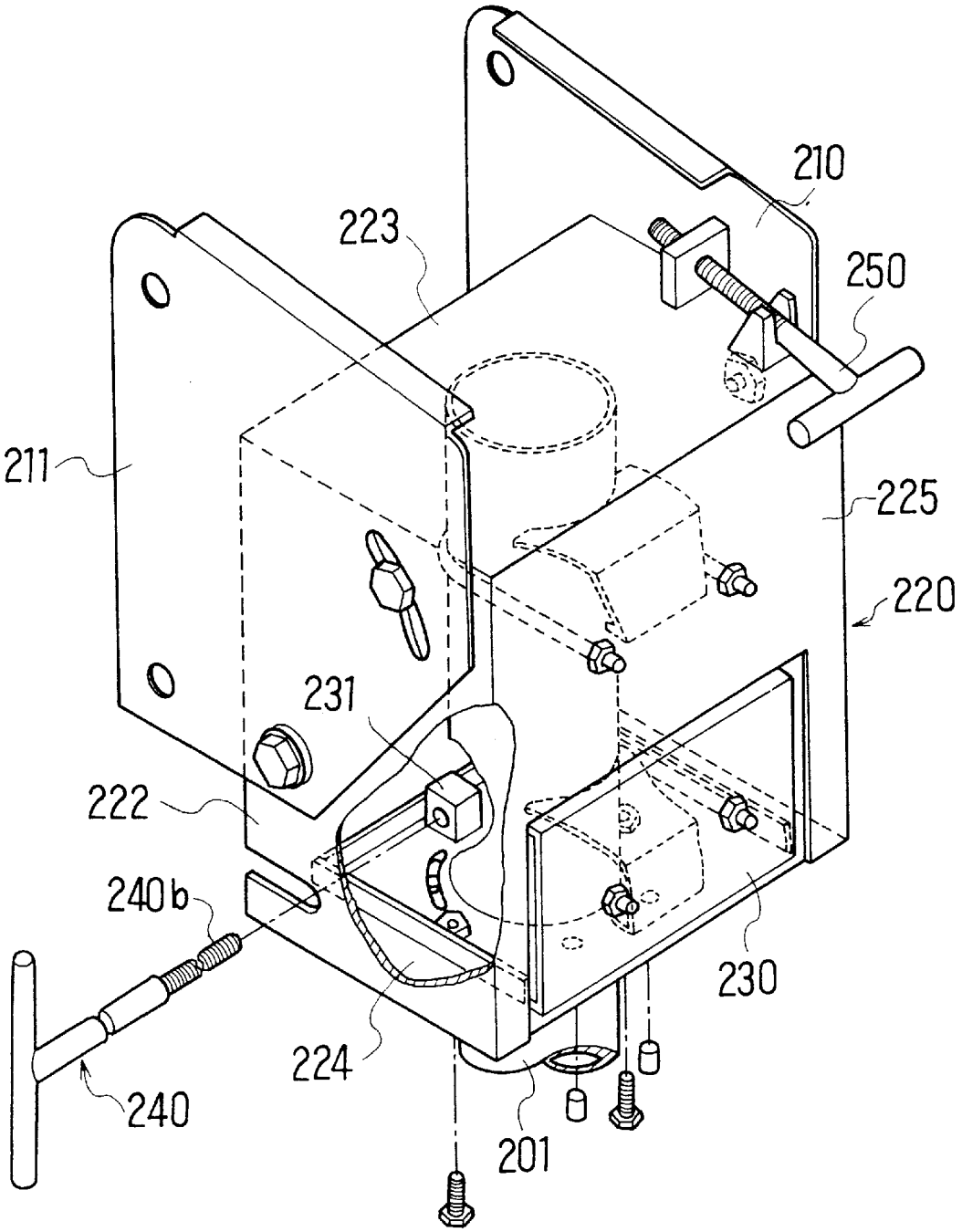

ANTENNA ADJUSTER

BACKGROUND OF THE INVENTION

The present invention relates to an antenna adjuster for adjusting the position, i.e., azimuth and elevation angles, of an antenna relative to a pole which the antenna is secured to and, more particularly, to an antenna adjuster which permits ready and accurate adjustment of the antenna with a simple, small-size and light-weight structure and is suited for fine adjustment of relatively small-size parabola antennas among the microwave antennas.

Among well-known antenna adjusters of this type are one for aerials (or antennas) parabola reflectors, as disclosed in Japanese Laid-Open Utility Model Publication No. 61-154003, and one as disclosed in Japanese Laid-Open Patent Publication No. 61-288502.

FIGS. 6 to 8 are views an example of the antenna adjusters disclosed in Japanese Laid-Open Utility Model Publication No. 61-154003. FIG. 6 is a schematic front view showing the antenna adjuster. FIG. 7 is a perspective view showing an essential part of the antenna adjuster shown in FIG. 6. FIG. 8 is a fragmentary side view showing the antenna adjuster shown in FIG. 6.

The illustrated antenna adjuster as described in Japanese Laid-Open Utility Model Publication No. 61-154003, comprises an arm 101 rotatably mounted on a pole 200 supporting the antenna 100 and secured to the pole 200 at an adequate position thereof, a horizontally rotatable base 102 mounted on the arm 101 and rotatable about an axis 107 of rotation in the azimuth angle directions, and a tiltable base 103 mounted on side walls of the horizontally rotatable base 102 and tiltable about horizontal axis 104, 105 of rotation parallel to the arm 101. The antenna 100 is mounted on the tiltable base 103.

A crank mechanism 110 is secured to the tiltable base 103, and a screw drive mechanism 111 is screwed to the crank mechanism 110. By turning a handle 111*a* a crank mechanism 110 is operated to cause rotation of the tiltable base 103 in the azimuth angle directions.

A crank mechanism 120 is secured to the horizontally rotatable base 102, and a screw drive mechanism 121 is screwed to the crank mechanism 120. By turning a handle 121*a* a crank mechanism 120 is operated to cause rotation of the horizontally rotatable base 102 in the azimuth angle directions.

With the above construction of the antenna adjuster disclosed in Japanese Laid-Open Utility Model Publication No. 61-154003, the antenna 100 can be driven by the crank mechanisms 110 and 120 and screw drive mechanisms 111 and 121 for rotation about the axis 104 and 105 as shown in FIG. 8 in the elevation angle directions and rotation about the axis 107 as shown in FIG. 7 in the azimuth angle directions.

In FIG. 6, reference numeral 106 designates a set bolt for securing the tiltable base 103 in position. The set bolt 106 penetrates the horizontally rotatable and tiltable bases 102 and 103, and can secure the tiltable base 103 after position adjustment to the hoirzontally rotatable base 102. The set bolt 106 displaceably penetrates a guide hole 106*a* formed in the titable base 103.

In FIG. 8, reference numerals 108 and 109 designate set bolts for securing the horizontally rotatable base 102 in position. The set bolts 108 and 109 penetrate the horizontally rotatable base 120 and the arm 101, and can secure the horizontally rotatable base 102 after position adjustment to the arm 101. In FIG. 7, the set bolts 108 and 109 displaceably penetrate guide holes 108*a* and 109*a* formed in the arm 101.

In the antenna adjusters disclosed in Japanese Laid-Open Patent Publication No. 61-288502, both the azimuth and elevation angles can be adjusted by operating an adjustment rod having a grip.

FIGS. 9 and 10 show an antenna adjuster shown in Japanese Laid-Open Patent Publication No. 1-288502. FIG. 9 is a perspective view showing the antenna adjuster in use. FIG. 10 is a partly broken-apart, exploded perspective view of the antenna adjuster.

The illustrated antenna adjuster disclosed in Japanese Laid-Open Patent Publication No. 61-288502 comprises a pair of elevation angle adjusting members 210 and 211 supporting the antenna 200 on the back thereof, a box-like housing 220 rotatably supporting the elevation angle adjusting members 210 and 211 and mounted on an antenna support pole (or post) 201 by accommodating the upper end thereof, and a mounting member 230 disposed on the bottom of the housing 220 and secured to the pole 201.

The housing 220 has a box-like shape constituted by side walls 221 and 222, on which the elevation angle adjusting members 210 and 211 are rotatably mounted, a top wall 223, a bottom wall 224 and a back wall 225. The housing 220 has an azimuth angle adjusting rod 240 mounted on one side and an elevation angle adjusting rod 250 mounted on the top.

With this antenna adjuster, for making azimuth angle adjustment, the azimuth angle adjusting rod 240 which is interlocked to the mounting member 230 in the housing 220, is rotated in a predetermined direction.

Rotation of the azimuth angle adjusting rod 240 causes a displacement of a movable nut 231 provided on the mounting member 230 by a threaded portion 240*b* of the adjusting rod 240.

As a result, the housing 220 is rotated about the pole 201 by a predetermined angle relative to the mounting member 230 secured to the pole 201. In this way, the azimuth angle of the antenna 200 can be adjusted.

For elevation angle adjustment, the elevation angle adjusting rod 250 which is mounted between the top wall 223 of the housing 220 and the elevation angle adjusting member 210, is rotated in a predetermined direction.

Rotation of the elevation angle adjusting rod 250 causes the elevation angle adjusting member 210 to be pushed or pulled by the elevation angle adjusting rod 250, thus causing rotation of the adjusting member 210 in contact with the side wall 221 of the housing 220.

The antenna 200 is rotatably mounted by the elevation angle adjusting members 210 and 211 on the housing 200, while the adjusting members 210 and 211 are coupled to each other via the antenna 200.

Thus, with rotation of the adjusting member 210 on the side of the provision of the elevation angle adjusting rod 250, in contact with the side wall 221 of the housing 220, the other adjusting member 211 is also rotated in contact with the other side wall 222. In this way, the elevation angle of the antenna 200 can be adjusted.

As shown above, the antenna adjuster disclosed in Japanese Laid-Open Patent Publication No. 61-288502 permits antenna adjustment in a simple operation and reliably. In addition, after the adjustment the antenna can be secured in position without possibility of rattling, and it is possible to effectively eliminate a deviation from the adjusted position.

The prior art antenna adjusters as described above, however, had the following problems.

In the antenna adjuster as disclosed in Japanese Laid-Open Utility Model Registration No. 61-154003, the elevation angle adjustment requires operations of adequately loosening the screws 104 and 105 and the set bolt 106, then making adjustment of the antenna with the crank mechanism 110 by operating the crank mechanism 111 with the handle 111*a* thereof and then re-tightening the screws 104 and 105 and the set bolt 106.

The azimuth angle adjustment also requires operations of adequately loosening the screw 107 and the set bolts 108 and 109, then making adjustment of the antenna with the crank mechanism 120 by operating the screw drive mechanism 121 with the handle 121*a* thereof and then re-tightening the screw 107 and the set bolts 108 and 109.

The prior art antenna adjuster of this type has many parts to be manipulated and also dictates very cumbersome adjusting operations when adjusting the antenna. Besides, since the crank mechanisms and screw drive mechanisms have complicated structures, the antenna adjuster itself comprises a large number of components, thus leading to structure complication and price as well weight increase.

In another aspect, the antenna support structure readily receives external forces such as wind pressures. With the antenna adjuster as disclosed in Japanese Laid-Open Utility Model Publication No. 61-154003, the arm as the antenna support extends from the pole, and this means that more rigid arm mounting structure is necessary, resulting in further size and weight increases of the antenna adjuster.

The antenna adjuster which has such a complicated and large size structure and requires cumbersome adjusting operations, is undesired from the standpoint of the demands for small size, light weight, ready handling and ready operation of parabola antennas and the like.

A further drawback in this type of prior art antenna adjuster is that no lock mechanism is provided in the handle part of the screw drive mechanism, which is operated when adjusting the antenna. Without any lock mechanism, a deviation from the adjusted antenna position may occur when re-tightening the screws and set bolts after the antenna has been adjusted. This means that it is particularly very difficult to make fine antenna adjustment.

With the antenna adjuster as disclosed in Japanese Laid-Open Patent Publication No. 61-288502, the antenna can be secured in position without possibility of rattling after the adjustment. It is thus possible to effectively eliminate any deviation from the adjusted position as in the case of the above Japanese Laid-Open Utility Model Publication No. 61-154003.

However, again the antenna adjuster as disclosed in Japanese Laid-Open Patent Publication No. 61-288502 is complicated in structure and inevitably tends to be large in size. In this respect, the same problem as in the antenna adjuster as disclosed in the above Japanese Laid-Open Utility Model Publication No. 61-154003 is posed. That is, it is impossible to solve the problem that the antenna adjuster is too elaborate to be used for relatively small antennas.

In addition, the antenna adjuster as disclosed in the Japanese Laid-Open Patent Publication No. 61-288502 is adapted to be installed by fitting the box-like housing on the upper end of the support pole (or post). This means that the installation requires very difficult operations in the case where the post has a high level. Furthermore, the upper end of the pole should have a shape and a size such that the box-like housing can be fitted on it. Moreover, for fitting the housing, the upper end of the pole should always be open.

In actual practice, the shape and size of the pole that permit installation of the box-like antenna adjuster are limited, and pose a problem that the antenna adjuster lack versatility.

SUMMARY OF THE INVENTION

The present invention has been proposed in order to solve the problems as discussed above, inherent in the prior art, and has an object of providing an antenna adjuster, which permits ready and accurate adjustment of the antenna with a simple, small-size and light-weight structure, and permits securing the antenna in position rigidly and without any limitation imposed on the shape and size of the antenna support pole.

According to a first aspect of the present invention, there is provided an antenna adjuster for securing an antenna to a pole such that the elevation and azimuth angles of the antenna are adjustable, comprising: a clamp unit mounted on the pole such as to be rotatable in the azimuth angle directions, an antenna mounting member mounted on the clamp unit such as to be rotatable in the elevation angle directions and secured to the antenna, azimuth angle adjusting means and elevation angle adjusting means; the clamp unit including an upper and a lower clamp disposed one above another along the pole and each including a pair of clamp members facing each other via the pole, the clamp members being secured to the pole such that their positions in the height and peripheral directions of the pole are adjustable; the antenna mounting member having a short and a long portion defining an L-shaped sectional profile; the short portion of the antenna mounting member being secured to one of the clamp members of the upper clamp of the clamp unit and capable of being rotated about an elevation angle rotation axis in the elevation angle directions; the long portion of the antenna mounting member being secured to the antenna mounting member; the clamp unit being adjustable in the azimuth angle directions by the azimuth angle adjusting means and also adjustable in the elevation angle directions by the elevation angle adjusting means.

With the antenna adjuster having the above construction, the upper one of the upper and lower clamps can be rotated about the pole in the azimuth angle directions by operating the azimuth angle adjusting means, and the antenna mounting member can be rotated about the elevation angle rotation axis member in the elevation angle directions by operating the elevation angle adjusting means.

Thus, it is possible to mount the antenna on the pole without need of a complicated arm structure or the like but with the sole simple, small-size and light-weight structure and mount and secure the antenna rigidly against wind pressures and other external forces.

In addition, it is possible to obtain ready and accurate fine adjustment of the antenna in the elevation and azimuth angle directions by merely operating the individual adjusting means while the antenna is mounted on the pole.

Furthermore, since the antenna can be mounted on the support pole by clamping the pole with the upper and lower clamps, the antenna adjuster can be mounted on poles having various diameters. It is not necessary to open the upper and or lower end of the pole and is possible to accommodate all of shapes and size poles.

According to a second aspect of the present invention, there is provided the antenna adjuster according to the first aspect, wherein: the azimuth angle adjusting means includes a shaft-like member extending parallel to the long portion of the antenna mounting means, a horizontally elongate hole formed on one of the clamp members of the upper clamp of the clamp unit, an end portion of the shaft-like member being engaged in the horizontally elongate hole, and a threaded hole formed in the opposite side one of the clamp members of the lower clamp of the clamp unit, the other end portion of the shaft-like member being engaged in the threaded hole; the end portion of the shaft-like member is engaged in the elongate hole such that it is capable of horizontally sliding along the horizontally elongate hole and incapable of being detached therefrom: and the shaft-like member is capable of pushing and pulling the upper clamp member with the elongate hole formed therein as it is axially screwed through the thread of the threaded hole.

With the antenna adjuster having the above construction, the upper clamp can be adjusted in the azimuth angle directions by merely manipulating the shaft-Like member of the azimuth angle adjusting means in the tightening or loosening direction. It is thus possible to obtain ready and reliable fine adjustment of the antenna with only a very simple structure.

In addition, after a desired antenna angle has been obtained, the azimuth angle adjusting means remains screwed in the threaded hole of the lower clamp, and no deviation from the adjusted position would be cause by the subsequent operation of tightening the set bolts.

According to a third aspect of the present invention, there is provided the antenna adjuster according to the first aspect, wherein: the elevation angle adjusting means includes a shaft-like member extending parallel to the short portion of the antenna mounting member, a perpendicularly extending engagement hole formed in the antenna mounting member, an end portion of the shaft-like member being engaged in the engagement hole, and a nut portion formed on one of the clamp members of the upper clamp of the clamp unit, the other end portion of the shaft-like member being screwed in the nut portion; the one end portion of the shaft-like member being engaged in the engagement hole such that it is vertically slidable along the engagement hole and incapable of being detached form the engagement hole; and the shaft-like member is capable of pushing and pulling the antenna mounting member with the engagement hole formed the rein as it is axially screwed through the thread of the nut portion.

With the antenna adjuster having the above construction, the antenna mounting member can be adjusted in the elevation angle directions by merely manipulating the shaft-like member of the elevation angle adjusting means. It is thus possible to obtain ready and accurate fine adjustment of the antenna in the azimuth angle directions with only a very simple structure.

According to a fourth aspect of the present invention, there is provided the antenna adjuster according to the first aspect, wherein: the azimuth angle adjusting means includes a shaft-like member extending parallel to the long portion of the antenna mounting means, a horizontally elongate hole formed on one of the clamp members of the upper clamp of the clamp unit, an end portion of the shaft-like member being engaged in the horizontally elongate hole, and a threaded hole formed in the opposite side one of the clamp members of the lower clamp of the clamp unit, the other end portion of the shaft-like member being engaged in the threaded hole; the end portion of the shaft-like member is engaged in the elongate hole such that it is capable of horizontally sliding along the horizontally elongate hole and incapable of being detached therefrom; the shaft-like member is capable of pushing and pulling the upper clamp member with the elongate hole formed therein as it is axially screwed through the thread of the threaded hole; the shaft-like member constituting the azimuth angle adjusting means has a notch formed in its end portion engaged in the elongate hole so that the portion with the notch formed therein can be displaced along the elongate hole, a nut being screwed on the end portion with the notch formed therein; and the nut is a special nut having a taper in the axial direction of the shaft-like member.

With the antenna adjuster having the above construction, the shaft-like member can be tilted in the elongate hole formed in the upper clamp, and the upper clamp can be displaced in the azimuth angle directions while being tilted relative to the shaft-like member when adjusting the antenna in the azimuth angle directions.

As the shaft-like member with the notch and the special nut is manipulated in the tightening or loosening direction, it is axially advanced or retreated, and the upper camp member with the elongate hole is pushed or pulled by the notch and the special nut. It is thus possible to readily and reliably cause rotation of the upper clamp over the lower clamp.

According to a fifth aspect of the present invention, there is provided the antenna adjuster according to the first aspect, wherein: the elevation angle adjusting means includes a shaft-like member extending parallel to the short portion of the antenna mounting member, a perpendicularly extending engagement hole formed in the antenna mounting member, an end portion of the shaft-like member being engaged in the engagement hole, and a nut portion formed on one of the clamp members of the upper clamp of the clamp unit, the other end portion of the shaft-like member being screwed in the nut portion; the one end portion of the shaft-like member being engaged in the engagement hole such that it is vertically slidable along the engagement hole and incapable of being detached form the engagement hole; the shaft-like member is capable of pushing and pulling the antenna mounting member with the engagement hole formed therein as it is axially screwed through the thread of the nut portion; the shaft-like member constituting the elevation angle adjusting means has a notch formed in its end portion engaged in the engagement hole so that the portion with the notch formed therein can be displaced along the engagement hole, a nut being screwed on the end portion with the notch formed thereon; and the nut is a special nut having a taper in the axial direction of the shaft-like member.

With the antenna adjuster having the above construction, the shaft-like member can be lifted in the engagement hole of the antenna mounting member, and the antenna mounting member can be displaced in the elevation angle directions while being tilted relative to the shaft-like member when adjusting the antenna in the elevation angle directions.

As the shaft-like member with the notch and the special nut is manipulated in the tightening or loosening direction, it is axially advanced or retreated, and the clamp member with the engagement hole is pushed or pulled. It is thus possible to readily and reliably cause rotation of the antenna mounting member in the elevation angle directions.

Furthermore, in the antenna adjuster having the construction as described above according to the present invention, the antenna adjusting mechanisms are constituted by sole basic mechanical structures such as bolts and nuts. The antenna adjuster itself thus can be very simple in construction, and it is possible to reduce the size and weight of the antenna adjuster.

Other objects and features will be clarified from the following description with reference to attached drawings.

BRIEF DESCRIPTION OF THE DRAWINGS

FIG. 8 is a fragmentary side view showing the antenna adjuster shown in FIG. 6;

FIG. 9 is a perspective view showing the antenna adjuster in use; and

FIG. 10 is a partly broken-apart, exploded perspective view of the antenna adjuster.

PREFERRED EMBODIMENTS OF THE INVENTION

Embodiments of the antenna adjuster according to the present invention will now be described with reference to the drawings.

Figure 1:
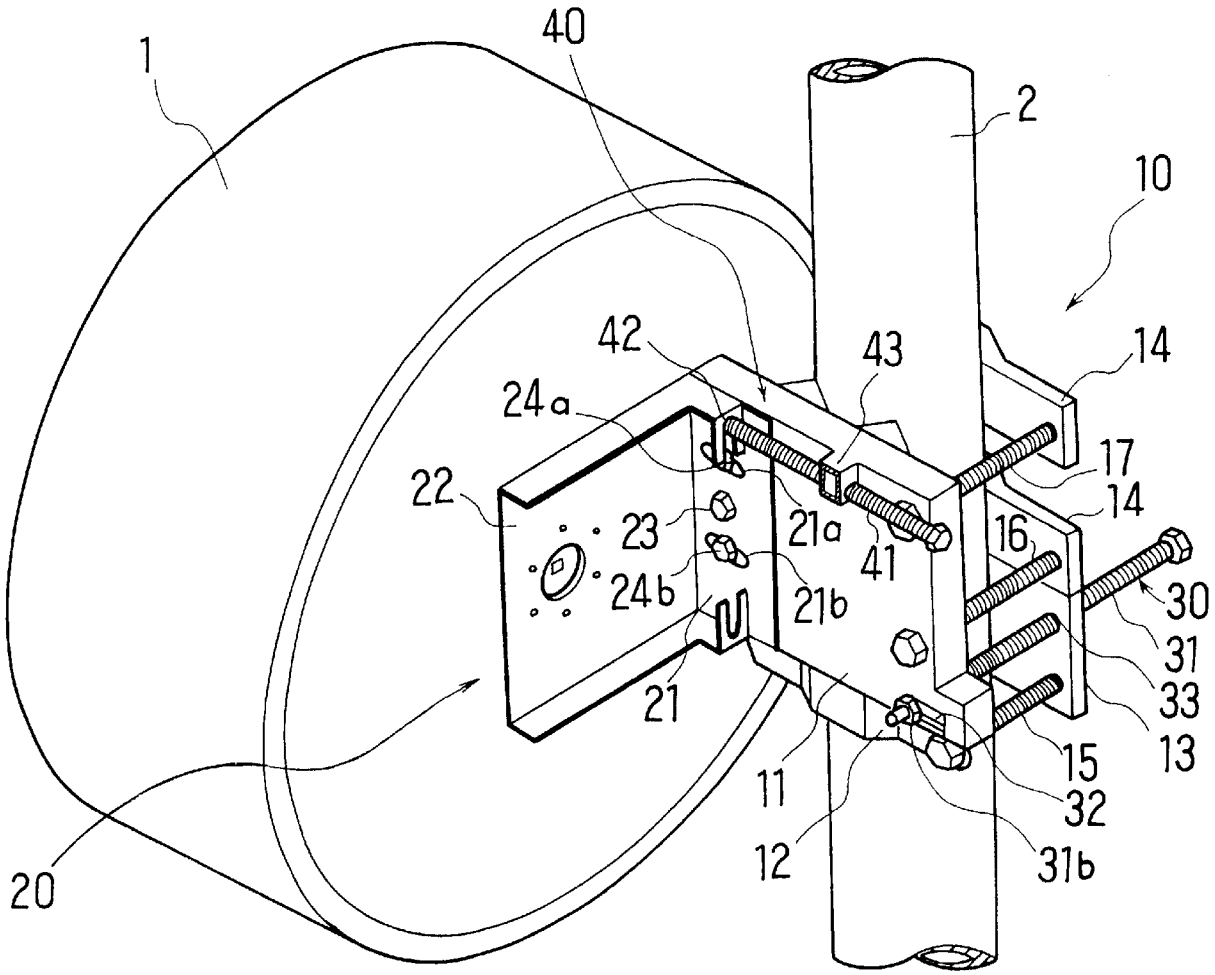
FIG. 1 is a perspective view showing an antenna mounted on a pole by the embodiment of the antenna adjuster.
Figure 2:
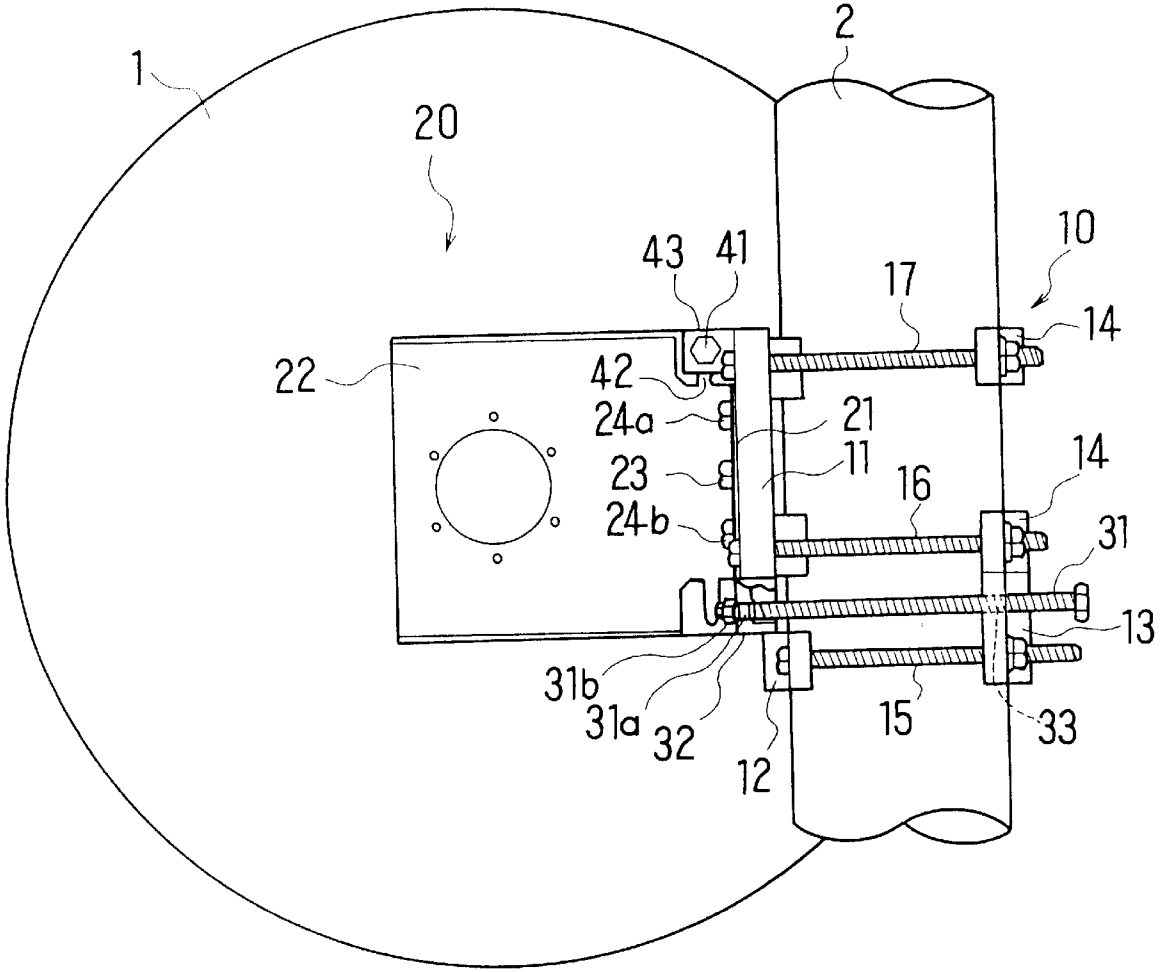
FIGS. 2 and 3 are a back view and a right side view showing the antenna shown in FIG. 1.
Figure 3:
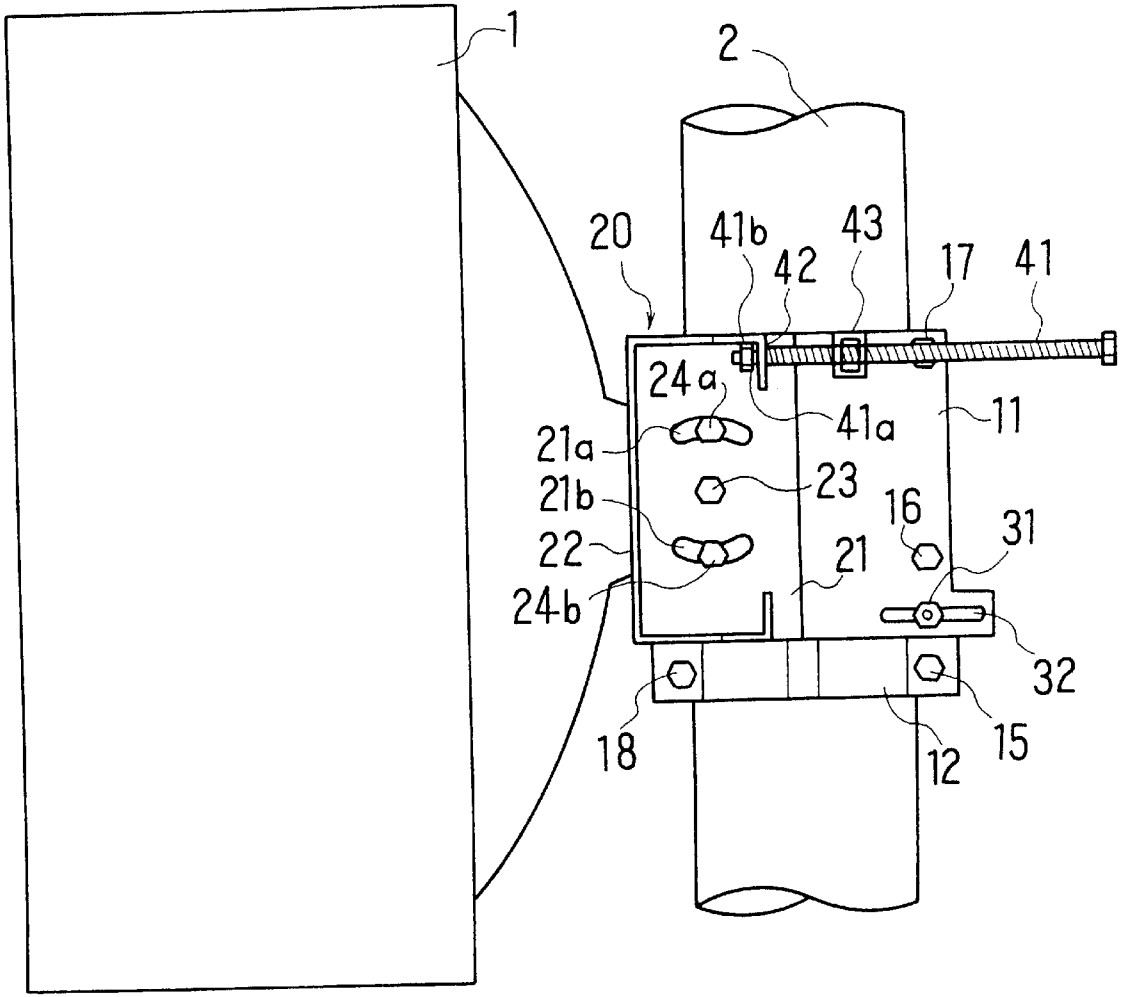
Figure 4:
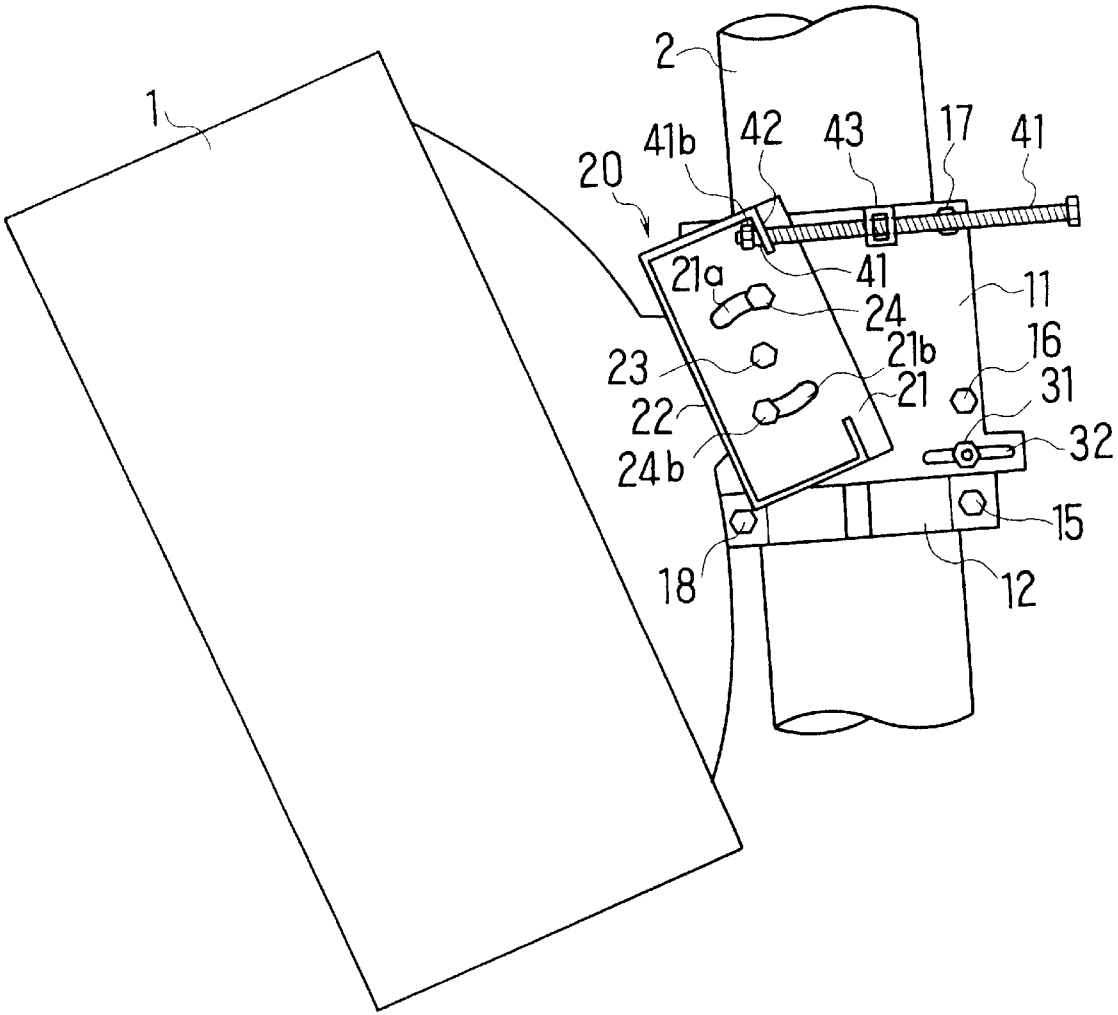
FIG. 4 is a right side view of the antenna having been rotated in an elevation angle direction by the antenna adjuster.
Figure 5:
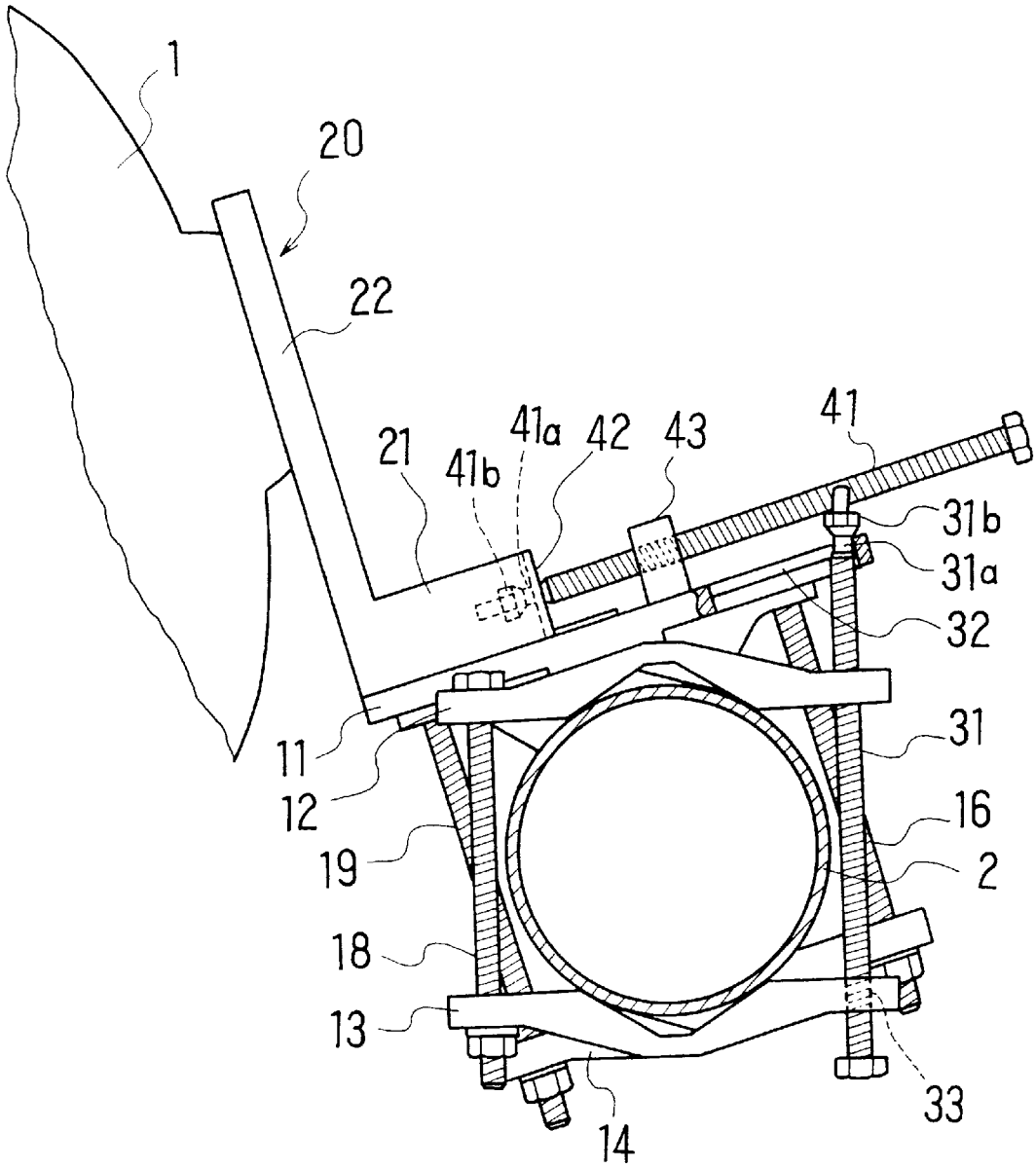
FIG. 5 is a bottom view showing the antenna adjuster shown in FIG. 4.
Figure 6:
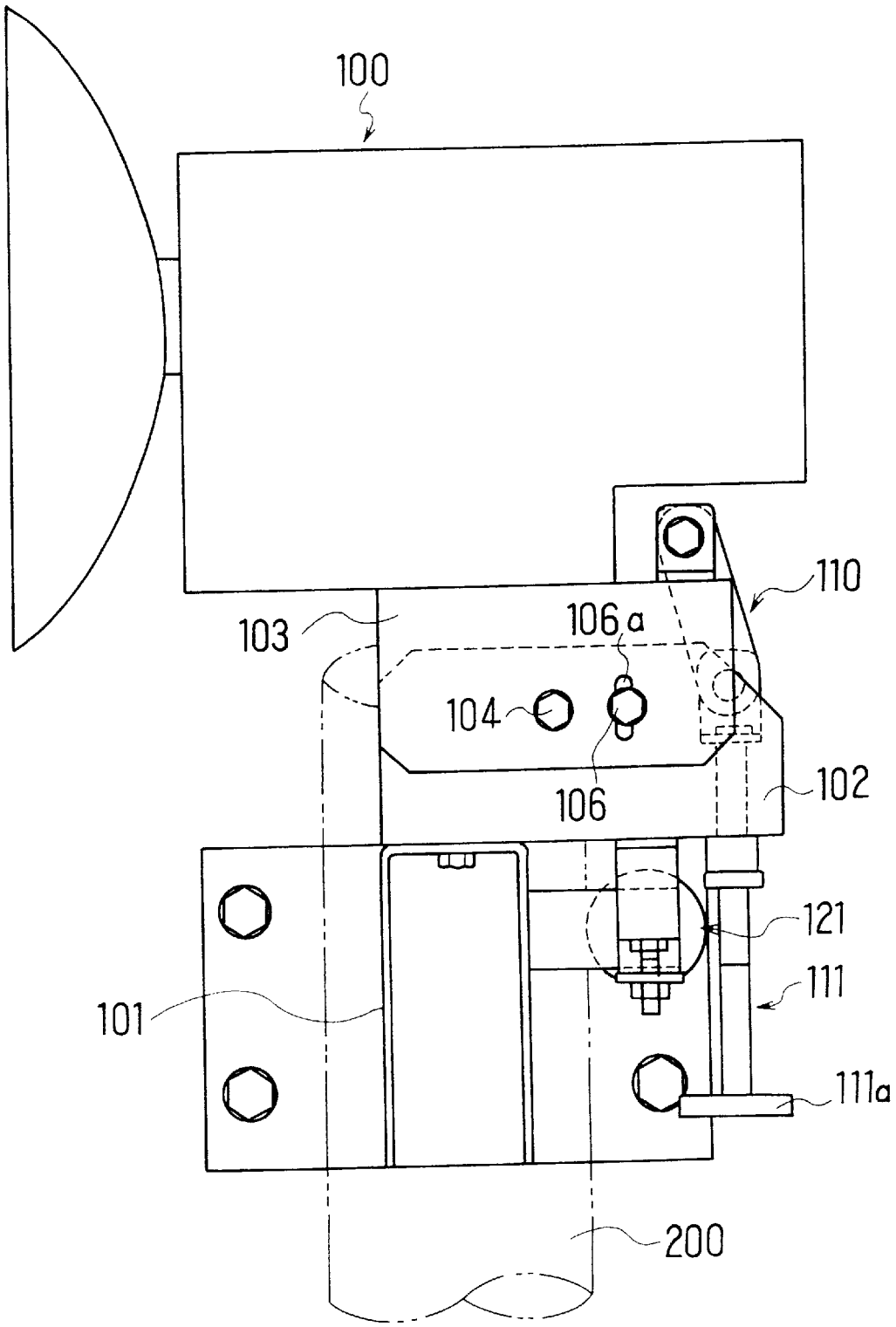
FIG. 6 is a schematic front view showing the antenna adjuster.
Figure 7:
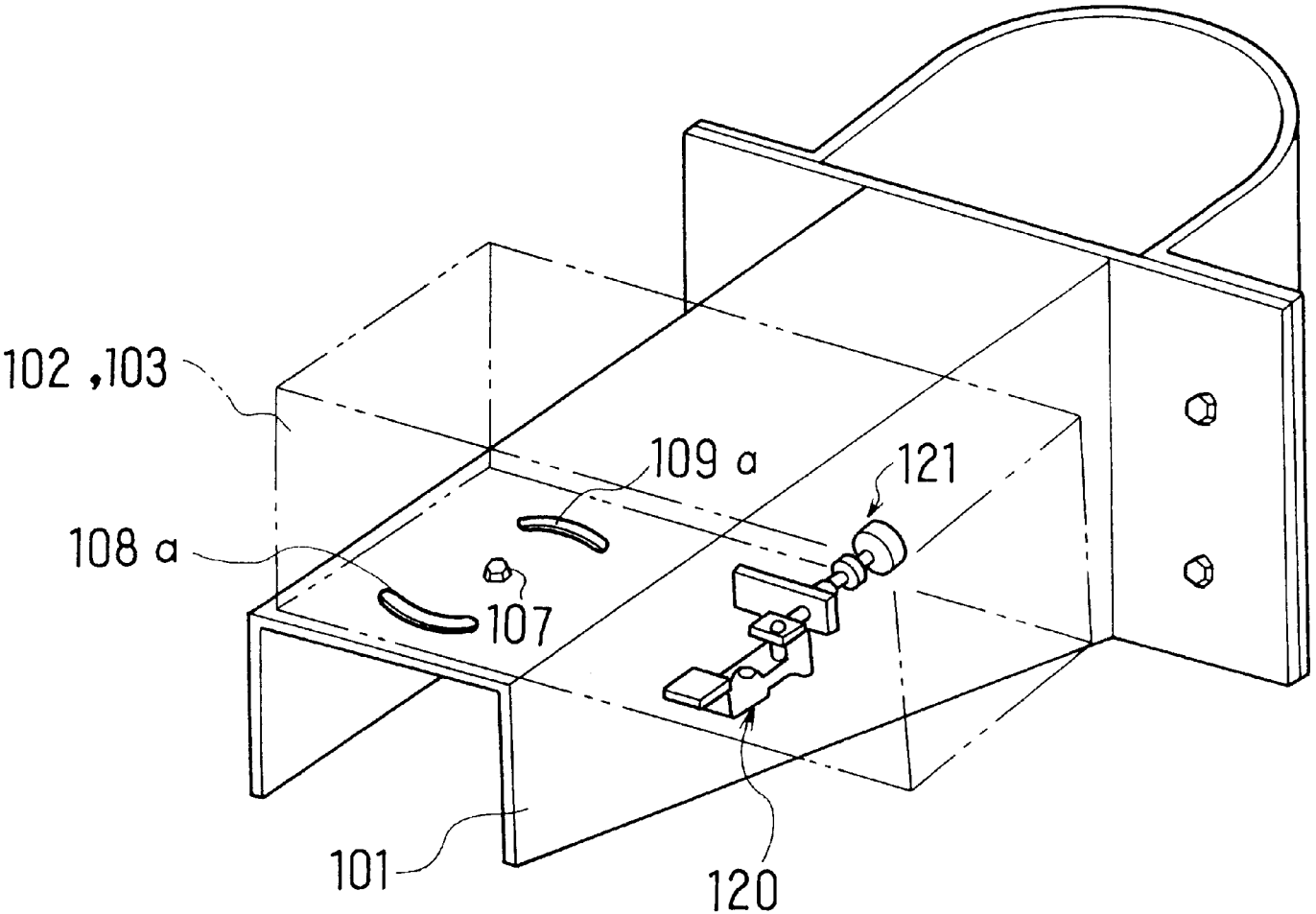
FIG. 7 PRIOR ART
FIG. 7 is a perspective view showing an essential part of the antenna adjuster shown in FIG. 6.

FIG. 1 is a perspective view showing an antenna mounted on a pole by the embodiment of the antenna adjuster. FIGS. 2 and 3 are a back view and a right side view showing the antenna shown in FIG. 1. FIG. 4 is a right side view of the antenna having been rotated in an elevation angle direction by the antenna adjuster. FIG. 5 is a bottom view showing the antenna adjuster shown in FIG. 4.

As shown in these Figures, the embodiment of the antenna adjuster, by which an antenna 1 is secured to a pole 2 such that its azimuth and elevation angles are adjustable. The antenna adjuster comprises a clamp unit 10 secured to the pole 2, an antenna mounting member 20 secured to the antenna 1, and azimuth and elevation angle adjusters 30 and 40.

The clamp unit 10 includes a plurality of clamps each constituted by a pair of plate-like clamp members facing each other via the pole 2. As shown in FIG. 1, the clamp unit 10 includes upper clamp members 11 and 14 and lower clamp members 12 and 13, the former members being disposed above the latter members in the height direction of the pole 2.

As shown in FIGS. 1 to 5, the clamp members are coupled to one another by bolts 15 to 19 for securing them together such that they are secured to the pole such that their positions in the height direction and peripheral direction of the pole 2 are adjustable.

The upper clamp members 11 and 14 face each other via the pole 2. As shown in FIG. 1, the upper clamp member 11 (i.e., the front one in FIG. 1) extends more downward than the other upper clamp member 14. A bolt 31 which constitutes azimuth angle adjusting means 30 as will be described later in detail and horizontally penetrates the lower clamp member 13, can engage with the upper clamp member 11 extending more downward than the other upper clamp member 14.

As will be described later in detail, the antenna mounting member 20 is mounted on the upper clamp member 11 such that its azimuth angle relative thereto is adjustable. The upper clamp member 11 has a nut 42, which receives a bolt 41 constituting elevation angle adjusting means 40 to be described later.

As shown in FIG. 1, the lower clamp members 12 and 13 face each other via the pole 2 below the upper clamp members 11 and 14. As shown in FIG. 1, the lower clamp member 13 (i.e., the rear one in FIG. 1) extends more upward than the other lower clamp member 12. Thus, as will be described later in detail, the bolt 31 which constitutes the elevation angle adjusting means 30 and horizontally penetrates the lower clamp member 13 extending more upward, does not penetrate the other lower clamp member 12.

The lower clamp, members 12 and 13 also serve to support the upper clamp members 11 and 14. As will be described later in detail, when adjusting the azimuth angle of the antenna 1, the upper clamp members 11 and 14 are rotatable in the azimuth angle directions over the lower clamp members 12 and 13. Also, when mounting the antenna 1 on the pole 2, the lower clamp members 12 and 13 support the upper clamp members 11 and 14.

As shown in FIGS. 1, 2 and 5, the upper and lower clamp members constituting the clamp unit 10, each have a recess formed in the surface facing the pole 2, so that they can clamp the pole 2 in engagement with the outer periphery of the pole 2. Thus, by tightening the bolts 15–19, the clamp members are secured to the pole 2 at desired positions in the height and peripheral directions of the pole 2 such that the pole 2 is clamped in their recesses facing one another.

The antenna mounting member 20 has a short and a long portion 21 and 22 defining an L-shaped sectional profile. The shaft portion 21 is mounted on the upper clamp member 11 of the clamp unit 10 for rotation about an elevation angle rotation axis member 23 in elevation angle directions. As shown in FIG. 1, the long portion 22 of the antenna mounting member 20 extends horizontally and is secured to the back surface of the antenna 1.

The elevation angle rotation axis member 23 is a shaft-like member and penetrates short portion 21 of the antenna mounting member 20 to serve as the axis of rotation. In this embodiment, the member 23 is a bolt which penetrates the short portion 21 of the antenna mounting member 20 and the upper clamp member 11 of the clamp unit 10.

Near the elevation angle rotation axis member 23, two set bolts 24 (i.e., 24*a* and 24*b*) are disposed such that they penetrate the upper clamp member 11 of the clamp unit 10 and the short portion 21 of the antenna mounting member 20.

The short portion 21 of the antenna mounting member 20 has curved guide holes 21*a* and 21*b* formed along a circle centered on the elevation angle rotation axis member 23 and elongate in the circumferential direction of the member 23. The two set bolts 24*a* and 24*b* penetrate the guide holes 21*a* and 21*b*, respectively. Thus, the antenna mounting member 20 which is penetrated by the set bolts 24*a* and 24*b*, can be rotated about the elevation angle rotation axis member 23 along the guide holes 21*a* and 21*b*.

In this embodiment, the guide holes 21*a* and 21*b* of the antenna mounting member 20 have a curved shape extending in the form of the circumference of the elevation angle rotation axis member 23. However, the guide holes 21*a* and 21*b* do not have to have a curved shape so long as they permit rotation of the antenna mounting member 20 with the set bolts 24 penetrating the member 20.

The elevation angle rotation axis member 23 and the set bolts 24 also serve as set bolts to secure the antenna mounting member 20 to the upper clamp member 11 of the clamp unit 10. More specifically, in the loosened state the elevation angle rotation axis member 23 and the set bolts 24 serve as the axis of and guide pins for the rotation of the antenna mounting member 20, and in the tightened state they serve as set bolts by which the antenna mounting member 20 is secured to the clamp unit 10.

The antenna mounting member 20 has an engagement hole 42, in which the bolt 41 constituting the elevation angle adjusting means 40 to be described later in detail is movably engaged.

As shown in FIG. 1, in this embodiment the engagement hole 42 is formed as a notch in a perpendicularly bent portion of an upper edge portion of the antenna mounting member 20. However, the engagement hole 42 may be of any form so long as it is elongated and capable of being perpendicularly movably engaged by the bolt 41 of the elevation angle adjusting means 40.

As shown in FIGS. 1 and 2, the azimuth angle adjusting means 30 is constituted by the adjusting bolt 31 which is a shaft-like member extending parallel to the long portion 22 of the antenna mounting member 20, a horizontally elongate hole 32, formed in the upper clamp member 11 of the clamp unit 10 and in which an end portion (on the front side of the pole 2 in FIG. 1) of the adjusting bolt 31 is engaged, and a threaded hole 33 formed in the lower clamp member 13 of the clamp unit 10 and in which the other end portion of the adjusting bolt 31 is screwed.

The shaft-like adjusting bolt 31 can push and pull the upper clamp member 11 having the elongate hole 32 as it is screwed axially through the thread of the threaded hole 33. The end portion of the adjusting bolt 31 that is engaged in the elongate hole 32 is capable of sliding along the elongate hole 32. The adjusting bolt 31 has a notch 31*a* formed in the end portion of the bolt engaged in the elongate hole 32 so that the portion formed with it can be displaced along the elongate hole 32. A special nut 31*b* is screwed on this end portion to prevent detachment of the end portion from the elongate hole 32.

The special nut 31*b* has a taper in the axial direction of the bolt such as the commonly known chamfered nut. This arrangement permits tilting of the adjusting bolt 31 in the elongate hole 32 of the upper clamp member 11. The upper clamp member 11 thus can be displaced in the azimuth angle direction as it is tilted relative to the adjusting bolt 31 when adjusting the azimuth angle of the antenna 1 as will be described later in detail.

By manipulating the adjusting bolt 31 with the notch 31*a* and the special nut 31*b* in the tightening and loosening directions, the adjusting bolt 31 is thus axially advanced and retreated. As a result, the upper clamp member 11 with the elongate hole 32 can be pushed and pulled by the notch 31*a* and the special nut 31*b* of the adjusting bolt 31, and the upper and lower clamp members 11 and 14 can be rotated over the lower clamp members 12 and 13 in the azimuth angle directions.

As shown in FIGS. 1 to 5, the elevation angle adjusting means 40 is constituted by the adjusting bolt 41 which is a shaft-like member extending parallel to the short portion 21 of the antenna mounting member 20, a vertically elongate engagement hole 42, which is formed in the antenna mounting member 20 and in which an end portion (on the side of the antenna 1 in FIG. 1) of the adjusting bolt 41 is engaged, and a nut portion 43 formed on the upper clamp member 11 of the clamp unit 40 and in which an intermediate portion of the adjusting bolt 41 is screwedly supported.

As described before, in this embodiment the engagement hole 42 is formed as a U-shaped notch in a peripherally bent portion of an upper edge portion of the antenna mounting member 20. However, the engagement hole 42 may be of any form other than notch, for instance a hole, so long as it is elongated and capable of being perpendicularly movably engaged by the bolt 43 of the elevation angle adjusting means 40.

The shaft-like adjusting bolt 41 can push and pull the antenna mounting member 20 with the engagement hole 42 formed therein as it is screwed axially through the thread formed in the nut portion 43. The end portion of the adjusting bolt 41 that is engaged in the engagement hole 42, is capable of sliding along the elongated hole 42.

The adjusting bolt 41, like the adjusting bolt 31 of the azimuth angle adjusting means 30 as described above, has a notch 41*a* formed in the end portion of the bolt engaged in the engagement hole 42 so that the portion formed with it can be displaced along the engagement hole 42. A special nut 41*b* is screwed on this end portion to prevent detachment of the end portion from the engagement hole 42. This arrangement permits tilting of the adjusting bolt 41 in the engagement hole 42 formed in the antenna mounting member 20. Thus, by manipulating the adjusting bolt 41 in the tightening and loosening directions, the adjusting bolt 41 is axially advanced and retreated. As a result, the antenna mounting member 20 with the engagement hole 42 can be pushed and pulled by the notch 41*a* and the special nut 41*b* of the adjusting bolt 41 and rotated about the axis 23 of rotation in the elevation angle directions.

The operation of the embodiment of the antenna adjuster having the above construction will now be described.

The antenna 1 is mounted on the pole 2 by using the antenna adjuster as follows. First, the lower clamp members 12 and 13 of the clamp unit 10 are coupled together with the set bolts 15 and 18, and then secured to the pole in a clamping relation thereto by tightening the bolts. The lower clamp members 12 and 13 are secured by coarsely adjusting their positions as desired in the height and peripheral directions of the pole. Then, the upper clamp members 11 and 14 are placed on the lower clamp members 12 and 13 and coupled together with the set bolts 16, 17 and 19. The bolts are then provisionally tightened.

This operation can be readily carried out because the upper clamp members 11 and 14 are supported by the lower clamp members 12 and 13. In this state, the adjusting bolt 31 of the azimuth angle adjusting means 30 is screwed through the threaded hole 33 such that its front end portion penetrates the elongate hole 32 in the upper clamp member 11, and the notch 31*a* is engaged in the elongate hole 32. Then, the special nut 31*b* is screwed on the end portion of the adjusting bolt 31 with the notch 31*a* formed therein, and tightened. In this way, the mounting of the clamp unit 10 on the pole 2 is completed.

The antenna mounting member 20 is mounted on the back surface of the antenna 1 as follows:

The antenna mounting member 20 having been mounted on the antenna 1, is positioned to the upper clamp member 11 of the clamp unit 10 mounted on the pole 2, and secured by using the bolt constituted by the elevation angle rotation axis member 23 and the set bolts 24*a* and 24*b*. In this state, the adjusting bolt 41 of the elevation angle adjusting means 40 is screwed through the nut portion 43 such that its front end portion penetrates the engagement hole 42 of the antenna mounting member 20, and the notch 41*a* is engaged in the engagement hole 42. Then, the special nut 41*b* is screwed on the end portion of the adjusting bolt 41 with the notch 41*a* formed therein, and tightened. In this way, the mounting of the antenna 1 to the pole is completed.

The fine adjustments of the azimuth and elevation angles of the antenna 1 are made as follows:

For the azimuth angle adjustment of the antenna 1, the set bolts 16, 17 and 19 by which the upper clamp members 11 and 14 are tentatively secured are adequately loosened. Then, for causing a displacement of the antenna to the right (i.e., clockwise about the pole 2) from the initial azimuth angle position after coarse adjustment, the adjusting bolt 31 of the azimuth angle adjusting means 30 is manipulated in the tightening direction. As the adjusting bolt 31 is manipulated in the tightening direction, it is advanced through the threaded hole 33 toward the upper clamp member 11 with the elongate hole 32 and pushes the upper clamp member 11. This pushing force causes rotation of the upper clamp member 11 and the other upper clamp member 14 coupled thereto to the right about the pole 2 over the lower clamp members 12 and 13.

In this operation, the upper clamp member 11 is tilted and displaced relative to the adjusting bolt 31 engaged in the elongate hole 32, and the adjusting bolt 31 is brought along the elongate hole 32 to a position further apart from the antenna 1 as shown in FIG. 5. In this way, the antenna 1 is adjusted to the right as its azimuth angle adjustment direction.

For causing a displacement of the antenna to the left from the initial azimuth angle position after coarse adjustment, converse to the above case, the adjusting bolt 31 is manipulated in the loosening direction. As a result, the adjustment bolt 31 is retreated to pull the upper clamp member 11. In this way, the antenna is adjusted to the left. In this operation, the upper clamp member 11 is tilted and displaced relative to the adjusting bolt 31 engaged in the elongate hole 32, and the adjusting bolt 31 is brought along the elongate hole 32 in the opposite direction to that in the case shown in FIG. 5 to a position closer to the antenna 1.

For the elevation angle adjustment, the elevation angle rotation axis member 23 and the set bolts 24*a* and 24*b* are adequately loosened. Then, for causing a displacement of the antenna 1 downward form the initial elevation angle position, the adjusting bolt 41 is manipulated in the tightening direction.

As the adjusting bolt 41 is manipulated in the tightening direction, it is advanced to the left in FIG. 4, i.e., toward the antenna 1, by the nut portion 43 screwed on it, and pushes the antenna mounting member 20 with the engagement hole 42 engaged therein. This pushing force causes rotation of the antenna mounting member 20 downward about the elevation angle rotation axis member 23 along the guide holes 21*a* and 21*b*. In this way, the antenna 1 is adjusted downward as its elevation angle adjustment direction.

In this operation, the antenna mounting member 20 is tilted and displaced relative to the adjusting bolt 41 engaged in the engagement hole 42, and the adjusting bolt 41 is brought along the engagement hole 42 to a more downward position. For causing a displacement of the antenna 1 upward from the initial elevation angle position, converse to the above case, the adjusting bolt 41 is manipulated in the loosening direction.

As the adjusting bolt 41 is manipulated in the loosening direction, it is retreated in the direction opposite to that in the case of FIG. 4, i.e., to the right, by the nut portion 43 screwed on it. As a result, the antenna mounting member 20 with the engagement hole 42 is pulled by the adjusting bolt 41, adjusting the antenna upward. In this operation, the antenna mounting member 20 is tilted and displaced relative to the adjusting bolt 41 engaged in the engagement hole 41, and the adjusting bolt 41 is brought along the engagement hole 42 to a more upward position.

When the azimuth and elevation angles of the antenna 1 have been adjusted to desired values by the above operations, the elevation angle rotation axis member 23 and set bolts 24 of the antenna mounting member 20 and the set bolts 16, 17 and 19 of the upper clamp member 11 are re-tightened. In this way, the adjustment of the antenna 1 is completed.

Since the adjusting bolts 31 and 41 of the azimuth and elevation angle adjusting means 30 and 40 are in screwed engagement with the threaded hole 33 of the lower clamp member 13 and the nut portion of the upper clamp member 11 while the re-tightening of the set bolts is made, no deviation from the adjusted position will result from the re-tightening operations.

As has been shown, with this embodiment of the antenna adjuster the upper clamp members 11 and 14 of the upper and lower clamps can be rotated about the pole 2 in the azimuth angle direction by operating the azimuth angle adjusting means 30, and the antenna mounting member 20 can be rotated about the elevation angle rotation axis in the elevation angle direction by operating the elevation angle adjusting means 40.

Thus, unlike the prior art no complicated arm structure is necessary, and the antenna 1 can be mounted on and secured to the pole 2 by a sole simple, small-size and light-weight structure such that it is rigid with respect to external forces such as wind pressures.

Moreover, the antenna 1 can be readily and reliably adjusted in the azimuth and elevation angle directions by merely operating the individual adjusting means in its state of being mounted on the pole 2.

Furthermore, the antenna 1 can be mounted on the pole 2 such that it is clamped by the upper and lower clamps. It is thus possible to accommodate various diameters of the pole 2. Also, the pole need not be open at the upper or lower end, and it is possible accommodate poles having various shapes and sizes.

Still further, the antenna 1 can be easily finely adjusted in the azimuth and elevation angle directions by operating the azimuth and elevation angle adjusting means 30 and 40. Also, the operation of tightening the set bolts can be made after desired antenna angles have been obtained, thus eliminating the possibility of deviation from adjustment of the antenna 1.

Further, the clamp unit 10 and the antenna mounting member 20 can be rotated in the azimuth and elevation angle directions according to the external tightening of the adjusting bolts of the azimuth and elevation angle adjusting means, and it is thus possible to readily and reliably finely adjust the antenna 1 in the state thereof secured to the pole 2 by merely operating the adjusting bolts.

Moreover, the antenna adjuster according to the present invention is constituted solely by basic mechanical structure, such as bolts and nuts, and it is thus very simple in structure as a whole and permits size and weight reduction.

As has been described in detail in the foregoing discussion, the antenna adjuster according to the present invention can be readily and accurately adjusted with simple, small-size and light-weight structure. Furthermore, it can be rigidly secured to a mounting pole without any restriction imposed on the shape and size of the pole, and can thus accommodate any mounting pole.

Changes in construction will occur to those skilled in the art and various apparent and different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. An antenna adjuster for securing an antenna to a pole such that elevation and azimuth angles of the antenna are adjustable, comprising:

a clamp unit mounted on the pole, the clamp unit including an upper and lower clamp disposed one above another along the pole and each including a pair of clamp members facing each other via the pole, the clamp members being secured to the pole such that their positions in the height and peripheral directions of the pole are adjustable and such that one of the upper clamp and the lower clamp is rotatable in the azimuth angle directions relative to the other;

an antenna mounting member mounted on the clamp unit such as to be rotatable in the elevation angle directions and secured to the antenna, the antenna mounting member having a short and a long portion defining an L-shaped sectional profile, the short portion of the antenna mounting member being secured to one of the clamp members of the upper clamp of the clamp unit and capable of being rotated about an elevation angle rotation axis in the elevation angle directions, the long portion of the antenna mounting member being secured to the antenna;

an azimuth angle adjusting assembly for adjusting the one of the upper clamp and the lower clamp in the azimuth angle directions relative to the other; and an elevation angle adjusting assembly, for adjusting the antenna mounting member in the elevation angle directions relative to the clamp unit.

2. The antenna adjuster according to claim 1, wherein:

the azimuth angle adjusting assembly includes a shaft-like member extending parallel to the long portion of the antenna mounting member, a horizontally elongated hole formed on one of the clamp members of the upper clamp of the clamp unit, a first end portion of the shaft-like member being engaged in the horizontally elongated hole, and a threaded hole formed in an opposing one of the clamp members of the lower clamp which opposes the one of the upper clamp members having the horizontally elongated hole formed therein, a second end portion of the shaft-like member being engaged in the threaded hole;

the first end portion of the shaft-like member is engaged in the elongated hole such that it is capable of horizontally sliding along the horizontally elongated hole and is incapable of being inadvertently detached therefrom; and the shaft-like member is capable of pushing and pulling the upper clamp member with the elongated hole formed therein as it is axially screwed through the threaded hole.

3. The antenna adjuster according to claim 1, wherein:

the elevation angle adjusting assembly includes a shaft-like member extending parallel to the short portion of the antenna mounting member, a perpendicularly extending engagement hole formed in the antenna mounting member, a first end portion of the shaft-like member being engaged in the engagement hole, and a nut portion formed on one of the clamp members of the upper clamp of the clamp unit, a second end portion of the shaft-like member being screwed in the nut portion;

the first end portion of the shaft-like member is engaged in the engagement hole such that it is vertically slidable along the engagement hole and is incapable of being inadvertently detached from the engagement hole; and the shaft-like member is capable of pushing and pulling the antenna mounting member with the engagement hole formed therein as it is axially screwed through the nut portion.

4. The antenna adjuster according to claim 1, wherein:

the azimuth angle adjusting assembly includes a shaft-like member extending parallel to the long portion of the antenna mounting member, a horizontally elongated hole formed on one of the clamp members of the upper clamp of the clamp unit, a first end portion of the shaft-like member being engaged in the horizontally elongated hole, and a threaded hole formed in an opposing one of the clamp members of the lower clamp which opposes the one of the upper clamp members having the horizontally elongated hole formed therein, a second end portion of the shaft-like member being engaged in the threaded hole;

the first end portion of the shaft-like member is engaged in the elongated hole such that it is capable of horizontally sliding along the horizontally elongated hole and is incapable of being inadvertently detached therefrom;

the shaft-like member is capable of pushing and pulling the upper clamp member with the elongated hole formed therein as it is axially screwed through the threaded hole;

the shaft-like member of the azimuth angle adjusting assembly has a notch formed in the first end portion engaged in the elongated hole so that the portion with the notch formed therein can be displaced along the elongated hole, and a nut screwed on the first end portion with the notch formed therein; and the nut is tapered in the axial direction of the shaft-like member.

5. The antenna adjuster according to claim 1, wherein:

the elevation angle adjusting assembly includes a shaft-like member extending parallel to the short portion of the antenna mounting member, a perpendicularly extending engagement hole formed in the antenna mounting member, a first end portion of the shaft-like member being engaged in the engagement hole, and a nut portion formed on one of the clamp members of the upper clamp of the clamp unit, a second end portion of the shaft-like member being screwed in the nut portion;

the first end portion of the shaft-like member is engaged in the engagement hole such that it is vertically slidable along the engagement hole and is incapable of being inadvertently detached from the engagement hole;

the shaft-like member is capable of pushing and pulling the antenna mounting member with the engagement hole formed therein as it is axially screwed through the nut portion;

the shaft-like member of the elevation angle adjusting assembly has a notch formed in the first end portion engaged in the engagement hole so that the portion with the notch formed therein can be displaced along the engagement hole, and a nut screwed on the first end portion with the notch formed therein; and the nut is tapered in the axial direction of the shaft-like member.

6. The antenna adjuster according to claim 2, wherein:

the clamp member of the upper clamp having the horizontally elongated hole formed therein extends further downward along the pole than the other clamp member of the pair of clamp members of the upper clamp of the clamp unit, and the opposing one of the lower clamp members having the second end portion of the shaft-like member engaged therein extends further upward along the pole than the other clamp member of the pair of clamp members of the lower clamp of the clamp unit.

7. An antenna adjuster for securing an antenna to a pole such that elevation and azimuth angles of the antenna are adjustable, comprising:

a clamp unit mounted on the pole so as to be rotatable in the azimuth angle directions, the clamp unit including an upper and lower clamp disposed one above another along the pole and each including a pair of clamp members facing each other via the pole, the clamp members being secured to the pole such that their positions in the height and peripheral directions of the pole are adjustable and such that one of the upper clamp and the lower clamp is rotatable in the azimuth angle directions relative to the other;

an antenna mounting member mounted on the clamp unit such as to be rotatable in the elevation angle directions and securable to the antenna;

an azimuth angle adjusting assembly for adjusting the one of the upper clamp and the lower clamp in the azimuth angle directions relative to the other; and an elevation angle adjusting assembly for adjusting the antenna mounting member in the elevation angle directions relative to the clamp unit.

8. The antenna adjuster according to claim 7, wherein:

the pair of clamp members forming the upper clamp includes a first upper clamp member which extends further downward along the pole than a second upper clamp member of the pair of clamp members forming the upper clamp of the clamp unit, and the pair of clamp members forming the lower clamp includes a first lower clamp member which extends further upward along the pole than a second lower clamp member of the pair of clamp members forming the lower clamp of the clamp unit, wherein the first upper clamp member is positioned above the second lower clamp member, and the second upper clamp member is position above the first lower clamp member.

9. The antenna adjuster according to claim 8, wherein the second lower clamp member and the first upper clamp member include corresponding holes which face each other, and wherein the azimuth angle adjusting assembly includes a shaft-like member engaged in the respective holes in the second lower clamp member and the first upper clamp member such that the upper clamp can be pushed and pulled in the azimuth angle directions by advancing or retreating the shaft-like member through the holes in the second lower clamp member and the first upper clamp member.

10. The antenna adjuster according to claim 7, wherein the antenna mounting member includes portion forming a first engagement hole and one of the clamp members of the pair of clamp members forming the upper clamp includes a portion forming a second engagement hole corresponding to and facing the first engagement hole, and wherein the elevation adjusting assembly includes a shaft-like member engaged in the respective engagement holes in the antenna mounting member and the one of the upper clamp members having the second engagement hole formed therein such that the antenna mounting member can be pushed and pulled in the elevation angle directions by advancing or retreating the shaft-like member through the holes in the antenna mounting member and the one of the upper clamp members having the second engagement hole formed therein.

* * * * *